United States Patent [19]

Ambal

[11] Patent Number: 4,488,336

[45] Date of Patent: Dec. 18, 1984

[54] BUCKLING DEVICE

[75] Inventor: Gilbert Ambal, Frepillon, France

[73] Assignee: ITW de France, Beauchamp, France

[21] Appl. No.: 467,405

[22] Filed: Feb. 17, 1983

[30] Foreign Application Priority Data

Feb. 26, 1982 [FR] France ..... 82 03212

[51] Int. Cl.[3] ..... A44B 11/25

[52] U.S. Cl. ..... 24/316; 24/194; 24/239; 24/313; 24/607

[58] Field of Search ..... 24/316, 313, 312, 310, 24/165, 194, 238, 239, 492, 523, 469, 606, 607, 605, 604

[56] References Cited

U.S. PATENT DOCUMENTS

| | | | |
|---|---|---|---|
| 545,966 | 9/1895 | Manes | 24/165 |
| 1,469,859 | 10/1923 | Veillette | 24/194 |
| 1,599,112 | 9/1926 | Boots | 24/239 |
| 1,607,085 | 11/1926 | Kilstrom | 24/606 |
| 2,216,499 | 10/1940 | Ohotto | 24/239 |
| 2,807,849 | 10/1957 | Legat | 24/316 |
| 3,384,938 | 5/1968 | O'Connor | 24/461 |
| 3,407,453 | 10/1968 | Invernizzi | 24/607 |
| 3,789,467 | 2/1974 | Aratani et al. | 24/313 |
| 3,999,258 | 12/1976 | Curry | 24/462 |
| 4,150,464 | 4/1979 | Tracy | 24/313 |

*Primary Examiner*—Victor N. Sakran

*Attorney, Agent, or Firm*—T. W. Buckman; J. R. Halvorsen

[57] ABSTRACT

The invention relates to a buckling device of the type having a strap or other connecting means, a male and a female elements, means for retaining said strap and male and female catch means. Said catch means consist of a retaining volume of said female element and a protuberance of said male element. Two abutments of said male elements cooperate with two obstacle means of said female element in such a way that said male and female catch means are preserved from any traction forces applied to the buckling device. The removal of said abutments of said element from said obstacle means of said female element is produced by the crushing of an elastic means of the male element within a holding volume of the female element.

5 Claims, 7 Drawing Figures

BUCKLING DEVICE

This invention relates to a buckle of the type comprising two elements i.e. a male element and a female element, and on each of these elements, retaining means for straps, strips, throat straps, chin straps, or the like.

According to the invention, the technical characteristics of this type of buckle is improved in particular as regards traction strength.

The object of this invention is to provide a buckle consisting of two elements, i.e. a male and a female elements, comprising catch means which are never submitted to traction forces produced on both of the elements of the buckle.

In accordance with the invention, the buckling device is characterized in that obstacle means is provided on the female element between a holding volume for such female element and a retaining volume for the same element, and in that complementarily there is provided on the male element at least one abutment means between an elastic crushing means and a protuberance on said male element in such a way that the contact of the obstacle means of the female element with the abutment means of the male element totally preserves from these traction forces, upon any traction forces being exerted upon both of these elements, the male and female catching means consisting of the retaining volume and the protuberance, with extraction of the abutment means of the male element from behind the obstacle means on the female element being achieved by crushing the elastic means, constantly under tension, of the male element in the volume of the female element.

Other characteristics and advantages of this invention will clearly appear in the following description which is made in reference to the attached drawings in which.

Figure 1:
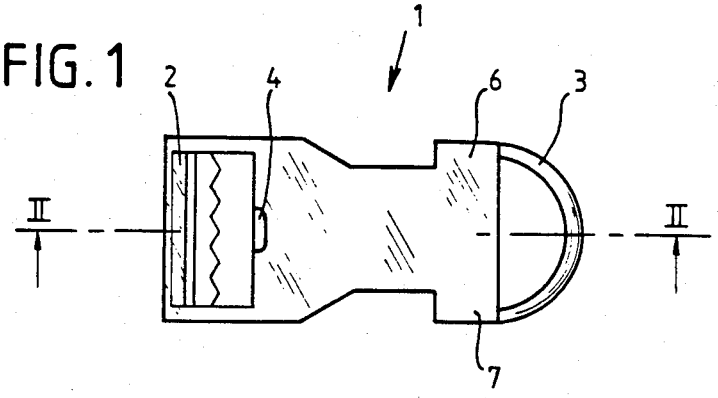
FIG. 1 is a plane view of a male element of a buckle according to the invention.
Figure 2:
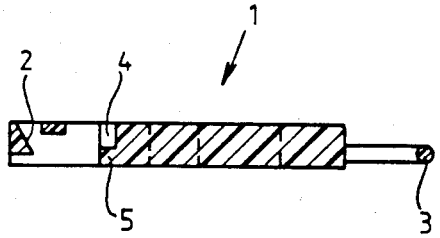
FIG. 2 is a sectional view through line II—II of FIG. 1.
Figure 3:
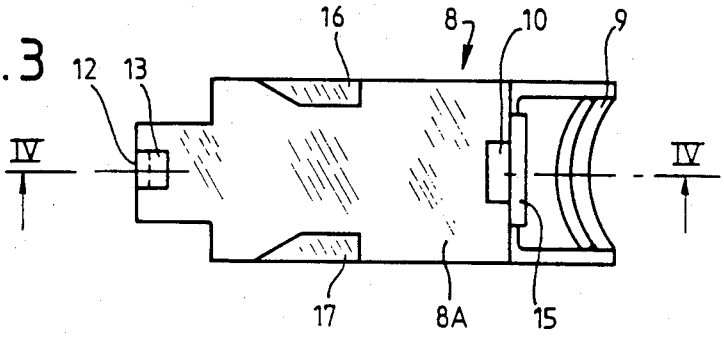
FIG. 3 is a plane view of the female element of the same buckle.
Figure 4:
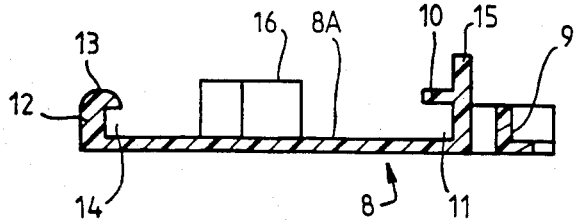
FIG. 4 is a sectional view through line IV—IV of FIG. 3.

In the illustrated form of embodiment, the male element 1 of the buckle comprises a strap retaining portion 2 and at the opposite end thereof an integral spring element 3 of a predetermined shape, operable elastically. A recess 4 formed in said male element forms a protuberance in the shape of a shoulder or catching tongue 5. Rearwardly of the elastic spring 3 the male element 1 is relieved by polygonal recesses 6*a* and 7*a* opening laterally to provide two abutment means 6 and 7 (FIGS. 1 and 2) substantially perpendicular to the longitudinal axis shown in line II—II in FIG. 1.

The female element 8 comprises a strap holding portion 9 at one end of a base 8A and a flange-like member 10 spaced above base 8A and supported by upright member 15 to produce a holding recess 11 between flange 10 and a base 8A of said element.

At the other end of the element 10 and opposite the retaining portion 9, there is provided a catch or finger 12 formed with a cammed shoulder 13 to produce a retaining volume 14. The female element is completed by a pusher member 15 and two abutments 16 and 17 which extend upwardly from base 8A and are generally complimentary to recesses 6*a* and 7*a*, respectively.

The retaining portion 9 accepts straps or belts and is advantageously of a curved shape to produce elasticity therein thereby, providing a damping effect causing a traction force upon the straps.

Figure 5:
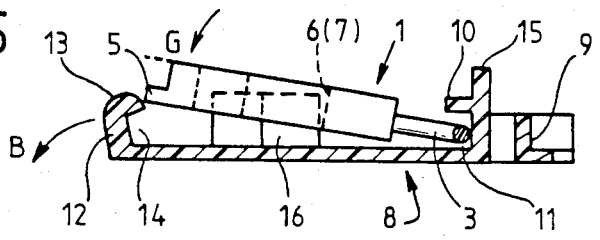
FIGS. 5, 6 and 7 are partial schematic views on a larger scale of the male element and the female element in various working positions.

The buckle according to the invention works as follows:

As the male element 1 (FIG. 5) is tippingly (in the direction of arrow G) fitted into the female element 8, the spring element 3 is brought by compression to position itself under tension in the recess 11 under the blade 10. As the tipping over(G) of the male element 1 continues, the tongue 5 comes to rest on the cam portion of cammed shoulder 13 of finger 12. Simultaneously, the abutments 6 and 7 of the male element 1 start presenting themselves in front of the abutments 16 and 17 of the female element 8. At this point it is sufficient to exert pressure upon the male element 1 in the direction of arrow (G). The finger 12 tips over according to arrow B (FIG. 5) and the tongue 5 is allowed to pass so as to position itself in the recess 14. At this moment, the finger 12 returns to its initial position, as shown by arrow A thereby imprisoning the tongue 5.

Figure 6:
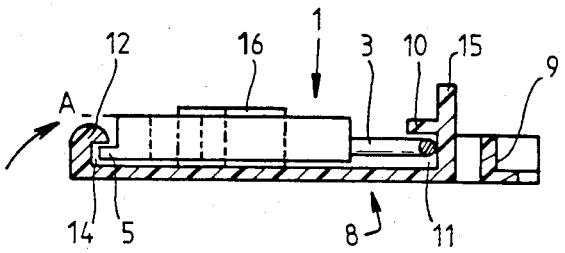

It can be noted that the male element 1 and the female element 8 are bound up to one another (FIG. 6) due to the locking under tension of the spring element 3 of the male element 1 under the blade 10 of the female element 8 and spring loads the tongue 5 of the male element 1 under the finger 12 of the female element 8. Moreover, the abutments 6 and 7 and 16 and 17 are engaged with one another.

When significant tractions occur upon the straps of both elements, the abutments 16 and 17 and 6 and 7 engaged with one another are alone submitted to the traction forces which are dampened thereby, so that significant forces can be obtained without interfering with the above described resilient portions of connecting system.

Engagement of abutments 16 and 17 and 6 and 7 also prevents any untimely lateral release of the buckle from shocks, the spring element 3 under tension insures holding the abutments in engagement with one another.

Figure 7:
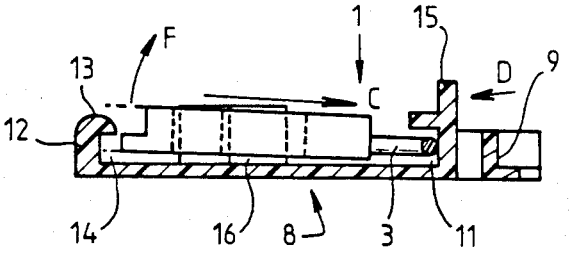

When both of the female 8 and male elements are to be separated the operation is different. It is required to push and depress the male element 1 according to arrow C (FIG. 7) while retaining the female element 8 (for example with a finger) in D. Reaction then occurs in the spring element 3 which elastically yields and shortens the length of the element between the ends of tongue 5 and the spring element 3 of the male element 1 thereby enabling the male element 1 to tip over according to arrow F, as seen in FIG. 7, by axial retraction of tongue 5 from the recess 14 formed by cammed shoulder 13 of the finger 12, which does not require movement thereof during the release operation.

Clearance can if desired be produced between abutments 16 and 17 and 6 and 7, depending on the conditions of use.

The finger 12 can be provided in any point of the female part 8.

Finally, it will be understood that this invention was only described and represented in a preferential exemplifying manner and that equivalent parts can be substituted for its constitutive elements without, however, departing from the scope thereof, as defined by the appended claims.

I claim:

1. A two piece plastic buckling device of the type for use with strap or other connection means including a male and a female elements, and a complementary catch means of each of said elements, said female element comprising a base, a holding recess means and a retaining recess means on said female element adjacent said base, obstacle means on said female element base positioned between said holding recess and said retaining recess, an integral elastic spring means and a complimentary protuberance on said male element, at least one intermediate abutment on said male element positioned between said elastic spring means and said complimentary protuberance in such a way that said obstacle means of said female element contacts and cooperates with said abutment of said male element, whereby when traction forces are exerted upon said two elements said abutment and obstacle means protects said male and female catch means consisting of said retaining recess and said complimentary protuberance, from said traction force, the removal of said abutment of said male element from behind said obstacle means of said female element being produced by compressing said spring means of said male elements in said holding recess of said female element.

2. A device according to claim 1, wherein two laterally spaced polygonal abutments extend upwardly from the base constitute said obstacle means of said female element, said abutments of said male element being complimentary to said obstacle means and formed by recesses each provided with right angle surfaces parallel with one of said abutments of said female element.

3. A device according to claim 1, wherein said base includes a web and a tongue spaced from said base on an upright member, said retaining recess of said female element being defined at least by said tongue relative to said web of said female element.

4. A device according to claim 1, further comprising an elastic finger on said female element, which elastic finger defines said retaining recess means.

5. A device according to claim 4, wherein said finger defining said retaining recess means includes a cammed ramp for meeting said protuberance of said male element.

* * * * *